US007413493B2

(12) United States Patent
Toht et al.

(10) Patent No.: US 7,413,493 B2
(45) Date of Patent: Aug. 19, 2008

(54) MAGNETIC BUILDING BLOCK

(75) Inventors: Donald E. Toht, Wheaton, IL (US); Gary D. Aigner, Naperville, IL (US)

(73) Assignee: RC2 Brands, Inc., Oak Brook, IL (US)

( * ) Notice: Subject to any disclaimer, the term of this patent is extended or adjusted under 35 U.S.C. 154(b) by 12 days.

(21) Appl. No.: 11/038,882

(22) Filed: Jan. 20, 2005

(65) Prior Publication Data

US 2005/0164595 A1 Jul. 28, 2005

Related U.S. Application Data

(60) Provisional application No. 60/539,527, filed on Jan. 27, 2004.

(51) Int. Cl.
*A63H 33/04* (2006.01)
*A63H 33/00* (2006.01)

(52) U.S. Cl. ..... 446/92; 446/131; 273/156

(58) Field of Classification Search ..... 446/92, 446/129, 137, 138, 139; 273/288, 156
See application file for complete search history.

(56) References Cited

U.S. PATENT DOCUMENTS

| | | | | |
|---|---|---|---|---|
| 3,254,440 | A * | 6/1966 | Duggar | 446/92 |
| 4,462,596 | A | 7/1984 | Yamamoto | |
| 5,009,625 | A | 4/1991 | Longuet-Higgins | |
| 5,021,021 | A | 6/1991 | Ballard | |
| 5,168,677 | A | 12/1992 | Pronsato et al. | |
| 5,362,271 | A | 11/1994 | Butt | |
| 5,409,236 | A | 4/1995 | Therrien | |
| 5,458,522 | A | 10/1995 | Brooks, III | |
| 5,746,638 | A | 5/1998 | Shiraishi | |
| 6,024,626 | A | 2/2000 | Mendelsohn | |
| 6,322,414 | B1 | 11/2001 | Lin | |
| 6,352,463 | B2 | 3/2002 | Forkman | |
| 6,431,936 | B1 | 8/2002 | Kiribuchi | |
| 6,749,480 | B1 * | 6/2004 | Hunts | 446/92 |
| 2004/0116038 | A1 | 6/2004 | Hunts | |

FOREIGN PATENT DOCUMENTS

| | | |
|---|---|---|
| EP | 0 051 576 A2 | 5/1982 |
| GB | 2 064 844 A | 6/1981 |
| GB | 2 123 306 A | 2/1984 |
| JP | 63119207 | 5/1988 |
| WO | WO 03/063993 A1 | 8/2003 |
| WO | WO 2004/062760 A1 | 7/2004 |

* cited by examiner

*Primary Examiner*—Kien T Nguyen
(74) *Attorney, Agent, or Firm*—Michael Best & Friedrich LLP

(57) ABSTRACT

A children's toy is disclosed, including a block, a casing affixed to the block, and a magnet housed within the casing, the magnet freely moveable within the casing. The freely moveable magnet allows for universal magnetic connections to be made with other similar blocks, as well as other fixed or moveable magnetic elements. Also disclosed are a variety of connectors that connect to the blocks in several different manners.

17 Claims, 8 Drawing Sheets

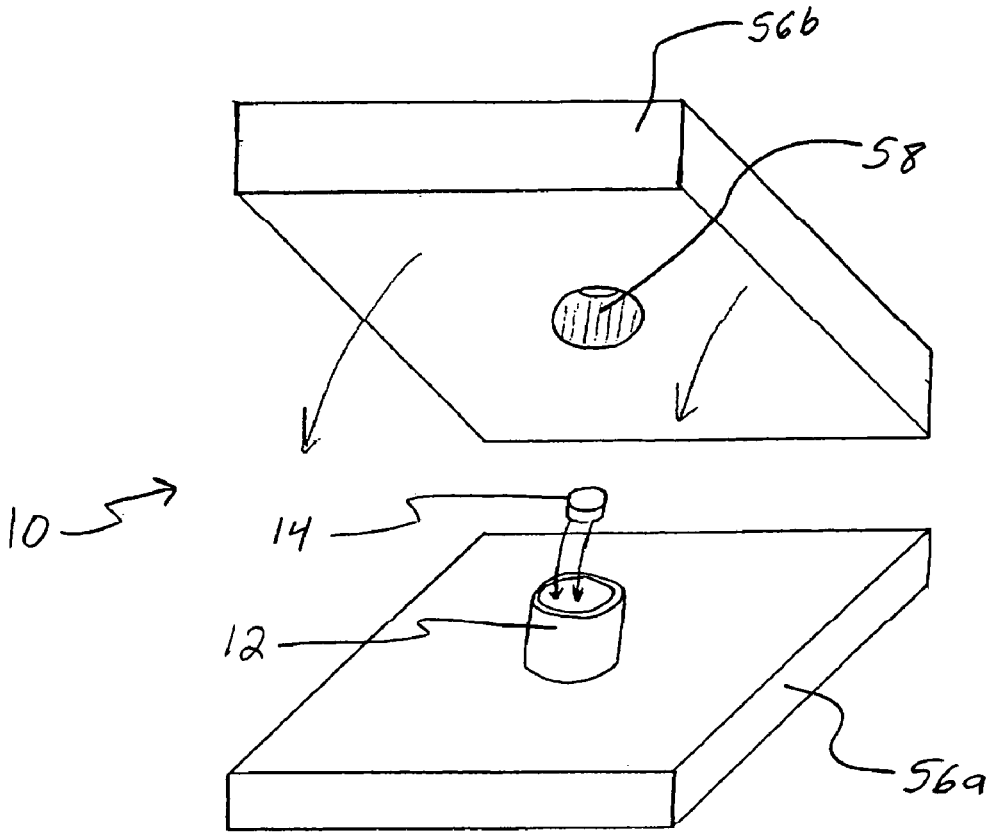
FIG. 7
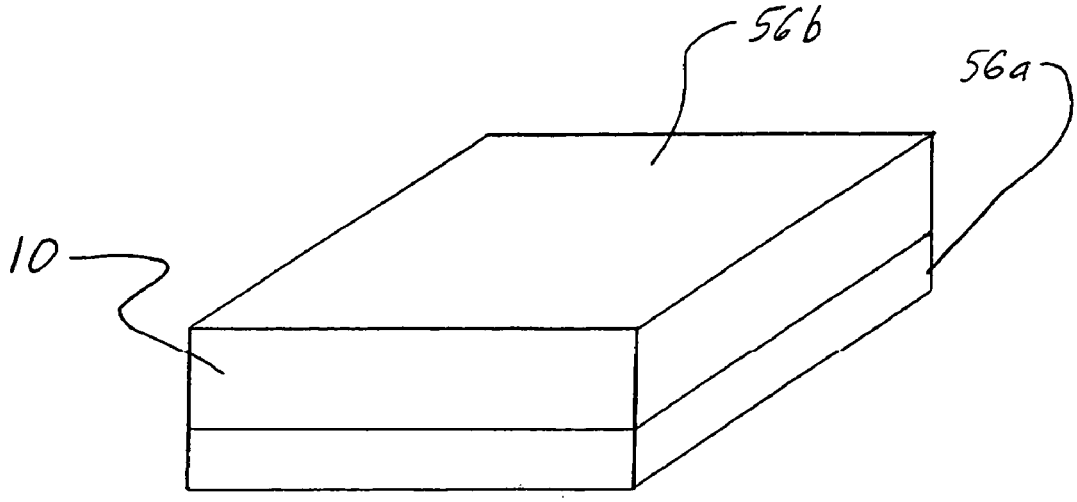

12
36
10
30
32
12
36
10
32
12
36
10
30

MAGNETIC BUILDING BLOCK

CROSS-REFERENCE TO RELATED APPLICATIONS

This application claims priority to U.S. Provisional Patent Application Ser. No. 60/539,527, filed Jan. 27, 2004.

TECHNICAL FIELD OF THE INVENTION

The present invention relates generally to the field of building blocks for use as a children's toy. More specifically, the preferred embodiment of the present invention relates to the use of freely moveable magnets inside building blocks to form universal magnetic connections between the blocks.

BACKGROUND

A wide variety of block toys presently exist, including those permitting connection of individual blocks by mutually snapping concave portions and convex portions formed in and on the individual blocks and those making use of a magnet arranged on a block and a magnetic member arranged on another block so that these blocks can be connected together by magnetic force.

Of the above-described conventional block toys, the former type of block toys, in which individual blocks are connected together by mutual snapping of concave portions and convex portions formed in and on the individual blocks, are limited in the direction of connection. A limitation is therefore obviously imposed on the number and variety of structures which can be formed by connecting the blocks. The latter type of block toys, which make use of blocks provided with magnets and blocks having magnetic members, are severely limited in the number of ways in which the blocks may be attached to each other, decreasing the versatility of the blocks and potentially frustrating a child attempting to build with the blocks.

Prior magnetic block systems have used rotatable disk magnets that are fixed in casings, but the magnets are not freely moveable within the casings. Instead, these magnets are polarized so that the poles are on opposite circumferential edges, and the magnets can only rotate about one fixed axis to align their poles with each other. However, in developing the present invention, freely moveable magnets polarized at opposite faces were found to form stronger magnetic connections than rotatable magnets polarized at opposite edges when incorporated into building blocks.

SUMMARY OF THE INVENTION

A children's toy is disclosed comprising a block, a casing affixed to the block and a magnet housed within the casing. The magnet is freely moveable within the casing, allowing the magnet to adjust relative to the pole of another magnet placed in its proximity. Thus, the block is universally attachable to other blocks having a similar magnet housed within a casing.

In one embodiment, the block is substantially hollow and the casing is formed, by an integral rib within the hollow block.

In another embodiment, the casing is affixed within a cavity in the block.

In another embodiment, the casing is integrally connected to the block.

In another embodiment, the magnet is disk-shaped, with a first circular face and a second circular face that is oppositely magnetically polarized with respect to the first circular face.

In another embodiment, the block is formed of a first piece having the casing integrally connected thereto and a second piece having a receptacle. In this embodiment, the block is formed by connecting the first piece and the second piece so that the casing fits within the receptacle.

In another embodiment, the block is substantially hollow and the casing is supported by an internal support within the hollow block.

In another embodiment, the block has a rotatable platform, and the casing affixed to the platform.

In another embodiment, the block is made of a first portion, a second portion, and a joint connecting the first portion and the second portion.

In another embodiment, the toy includes a plurality of casings affixed to the block and a plurality of magnets. Each casing housing one of the plurality of magnets such that the magnet is freely moveable within the casing. According to one aspect of this embodiment, each of the plurality of casings is integrally connected to the block. According to another aspect of this embodiment, each of the plurality of magnets is disk-shaped, having a first circular face and a second circular face that is oppositely magnetically polarized with respect to the first circular face. According to another aspect of this embodiment, the block has a plurality of faces, with one of the plurality of casings affixed on each face.

In another embodiment, the toy includes a second block, a second casing affixed to the second block, and a second magnet housed within the second casing. The second magnet freely moveable within the second casing. In this embodiment, the first and second blocks are temporarily connectable by magnetic attraction between the first and second magnets.

The present invention also provides a children's toy comprising a block, a casing affixed to the block, a magnet housed freely moveable within the casing, and a connector. The magnet is freely moveable within the casing, and the connector is configured to be temporarily connectable to the block.

In another embodiment, the block is connectable to the connector by a snap fit connection.

In another embodiment, the connector has a magnetic contact, and the block is connectable to the connector by magnetic attraction between the magnet and the magnetic contact.

In another embodiment, the children's toy includes a second block, a casing affixed to the second block, and a magnet housed within the casing. Again, the magnet is freely moveable within the casing. The first and second blocks are temporarily connectable by magnetic attraction between the two magnets to form a juncture, and the connector includes a collar adapted to peripherally enclose the juncture.

In another embodiment, each of the two blocks has an indented portion with a narrowed cross-sectional area, and the juncture is formed by connection between the two indented portions.

The present invention also provides a children's toy comprising a substantially hollow block having a plurality of faces, two casings affixed to the block, and two disk-shaped magnets, each magnet housed within one of the two casings. Each of the two casings is adjacent a face of the block, and is supported by one or more internal supports contained within the hollow block. Each magnet has two circular faces oppositely magnetically polarized with respect to each other and is freely moveable within its respective casing.

DESCRIPTION OF THE DRAWINGS

FIG. 7 is a perspective view of a fourth embodiment of the toy of the present invention, showing both assembled and exploded views;

DETAILED DESCRIPTION OF THE INVENTION

While the invention is susceptible of embodiment in many different forms, this disclosure describes, in detail, preferred embodiments of the invention with the understanding that the present disclosure is to be considered as an exemplification of the principles of the invention and is not intended to limit the broad aspects of the invention to the embodiments illustrated.

Figure 1:
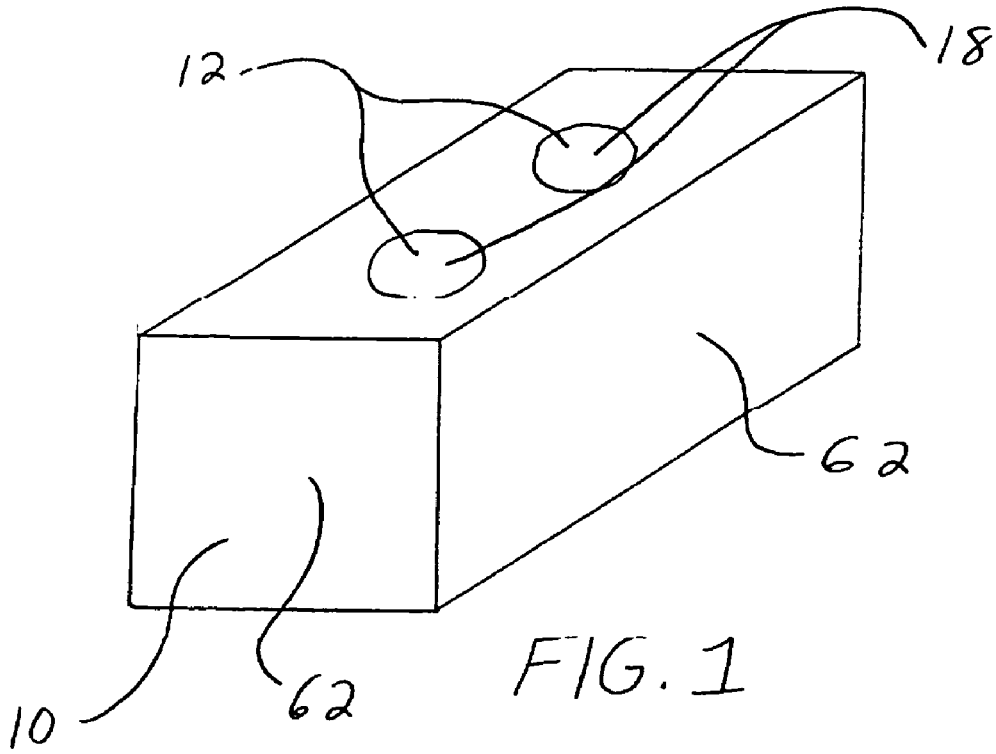
FIG. 1 is a perspective view of a toy of the present invention.

The present invention is generally a children's toy, specifically a plastic building block 10 having at least one magnet casing 12 affixed inside the block 10, as shown in FIG. 1. Each magnet casing 12 holds a freely moveable magnet 14 inside. When two such magnet casings are placed in close proximity, the magnets 14 inside can turn or flip over to align their poles North-to-South or South-to-North, creating magnetic attraction between them. This feature allows two or more blocks 10 to be temporarily attached to each other by magnetic force. In addition, the present invention also contemplates the use of connectors 30 to attach blocks 10 to each other in a variety of manners.

Figure 4:
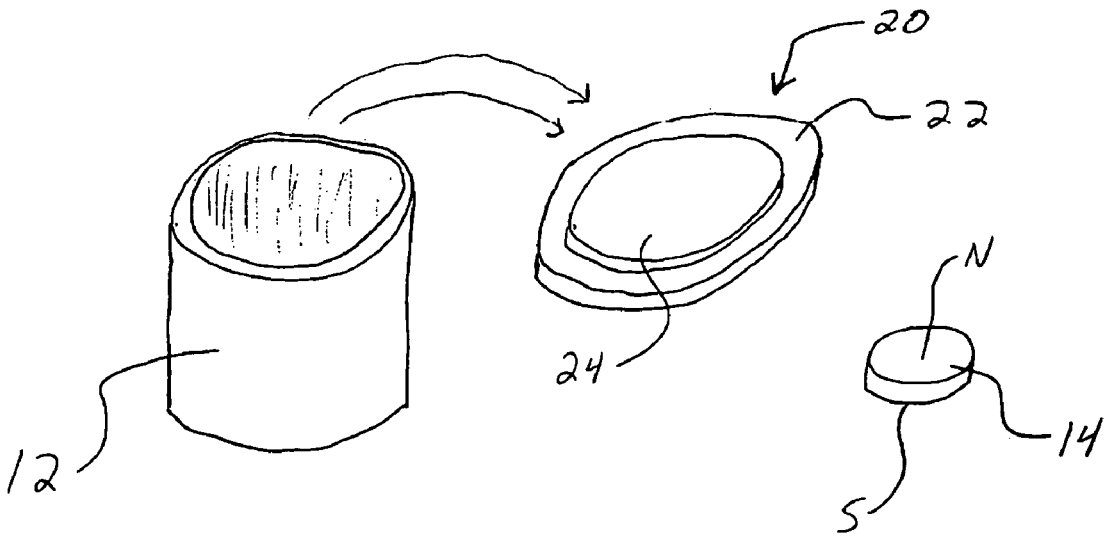
FIG. 4 is a perspective view of a casing and a magnet of the present invention.

The preferred magnet 14 of the present invention is a small disk-shaped magnet 14, polarized so that the north (N) and south (S) poles are on opposite circular faces of the disk 14, as shown in FIG. 4. Alternatively, the magnet 14 may have one of a number of different possible shapes or polarizations. For example, the magnet 14 may be a cylinder or a bar magnet. The magnet 14 may also be disk-shaped, with the poles both located on opposite circumferential edges of the disk rather than opposite faces. However, the shape and polarization of the magnet 14 are not limitations of the present invention unless specifically set out in the claims.

Additionally, the magnet 14 must be powerful enough to create a magnetic force sufficient to hold two or more blocks 10 together. The strength of the magnetic field required to do this depends on the weight of the block 10, the material it is constructed from, and the thickness of the walls of the casing 12. However, the magnet 14 is preferably not so powerful that it interferes with other magnets 14 within the same block 10. It is desirable for a magnet 14 of one block 10 to only have significant magnetic interaction with a magnet 14 of another block 10 being stacked upon it.

Figure 3:
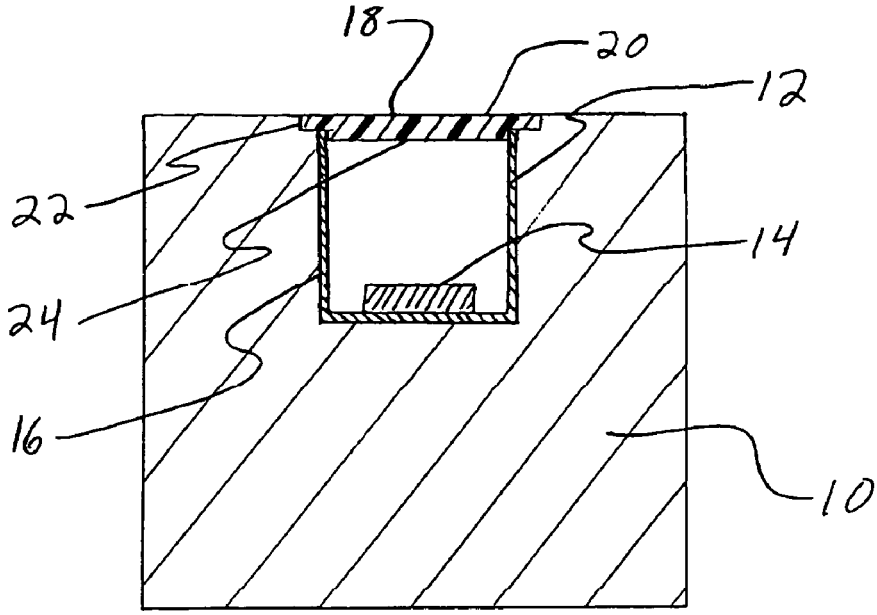
FIG. 3 is a cross-sectional view of the toy of FIG. 1, taken along lines 3-3 of FIG. 2.

Finally, the magnet 14 must be small enough to fit within the magnet casing 12, having sufficient clearance space to be freely moveable within the casing 12, as shown in FIG. 3. In other words, the magnet 14 is allowed to float within the casing 12 with at least some freedom of movement in every direction, and having no fixed or preferred position or limitations on rotation about any axis. The range of movement of the magnet 14 need only be sufficient to allow the magnet 14 to rotate to bring either pole in proximity to the contact surface 18 of the casing 12. However, the casing 12 may allow the magnet 14 a greater range of motion.

Figure 5:
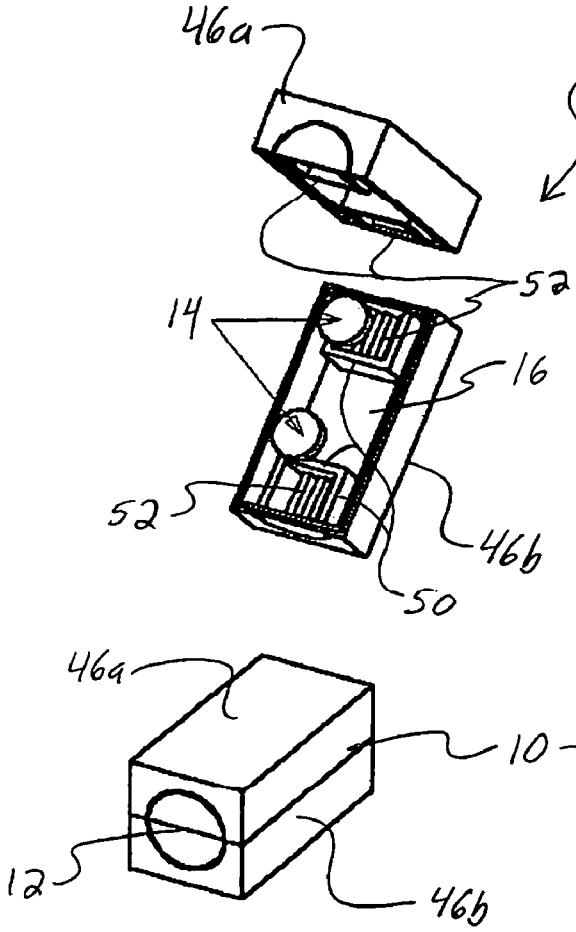
FIG. 5 is a perspective view of a second embodiment of the toy of the present invention, showing both assembled and exploded views.
Figure 6:
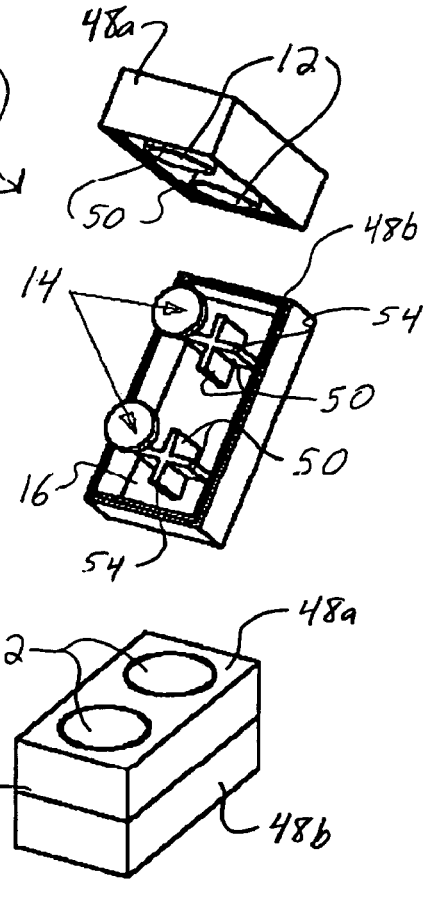
FIG. 6 is a perspective view of a third embodiment of the toy of the present invention, showing both assembled and exploded views.

The casing 12 houses the magnet 14 and is preferably a hollow, thin-walled plastic cylinder. Other materials may be used for the casing 12, but plastic is preferable due to its light weight, ease of manufacturing, and lack of magnetic interference. The casing 12 preferably has thin walls to maximize the attractive force of the magnet 14. In one embodiment, the casing 12 is integral with the block 10, as illustrated in FIGS. 5-7, which may be accomplished in several ways, as discussed below. Preferably, the casing 12 is separate from the block 10 and is attached to the block 10 by affixing it to the block 10, as shown in FIGS. 1-4. If the casing 12 is separate from the block 10, it is preferably affixed within a cavity 16 in the block 10, but may also be affixed to the block 10 in another manner. Also, if the casing 12 is separate from the block 10, the casing 12 is preferably manufactured by injection molding, but many other manufacturing processes known in the art will function suitably. Further, if the casing 12 is separate from the block 10, the casing 12 preferably includes a cap 20 with an outer flange 22 and an inner projection 24, useful for sealing the casing 12. In this configuration, the inner projection 24 of the cap 20 fits inside the casing 12 and is held in place by either an interference fit or by gluing, welding, or other such means. Additionally, in the hollow block 10 shown in FIG. 15, the casing 12 has an outer projection 26 extending through a hole 28 in the block 10. The flange 22 prevents the rest of the casing 12 from moving through the hole 28. The casing 12 shown in FIGS. 3 and 4 has no outer projection 26.

As stated above, the casing 12 must be large enough to allow sufficient clearance space for the magnet 14 to be freely moveable. However, the casing 12 must not be so large that the magnet 14 sits too deeply within the block 10 to be affected by other magnetic elements. The size of the casing 12 is further limited by the size of the block 10 into which it is inserted and the number of casings 12 within the same block 10. A variety of different casing 12 sizes will work with the present invention. Additionally, the shape of the casing 12 may vary, but preferably the casing 12 and the block 10 share at least one contact surface 18 that is flat, promoting level contact with the surfaces of other blocks 10 or casings 12.

Figure 2:
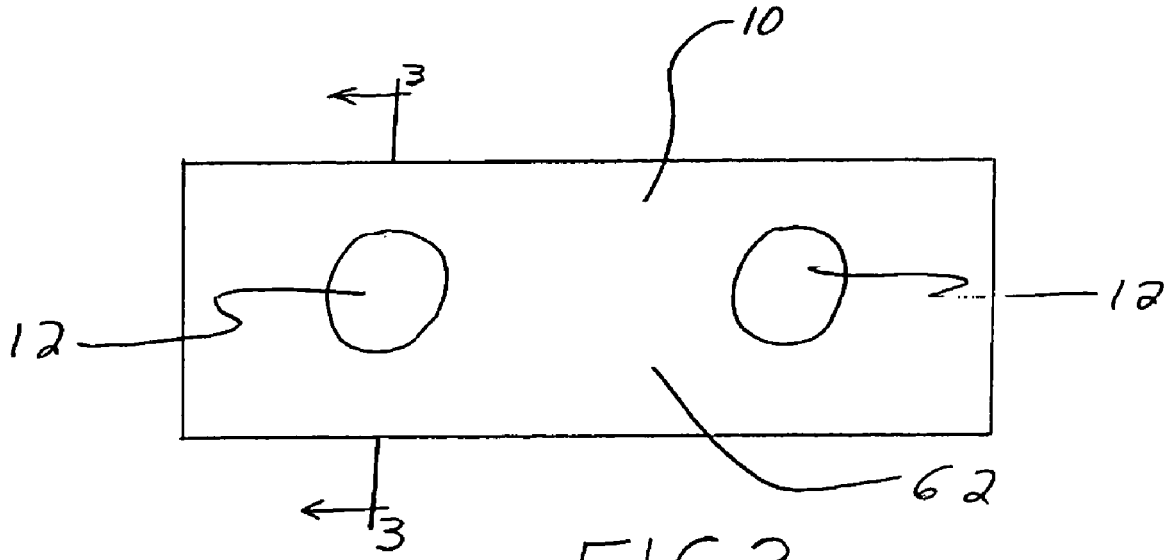
FIG. 2 is a top plan view of the toy of FIG. 1.

The block 10 is generally a plastic square or rectangle having one or more cavities 16 to permit attachment of magnet casings 12, illustrated generally in FIGS. 1-3. Many different sizes and shapes of blocks 10 may be used with the present invention, and the size or shape of the block 10 may allow for a greater or fewer number of magnet casings 12. An individual block 10 may have a casing 12 on each face 62, or only on certain faces 62, and may even have more than one casing 12 on a given face 62. More complicated block 10 designs and casing 12 arrangements are discussed below.

The block 10 is preferably plastic and is created by injection molding, a processing technique known in the art of plastic toy manufacturing. If cavities 16 are used for insertion of separate casings 12 in a solid block 10, the cavities 16 are preferably created by molding, rather than by drilling after molding. However, drilling is an alternate means of creating the cavities 16. The blocks 10 may also be made of wood or another material, which may require the cavities 16 to be drilled. Alternately, the casing 12 is integrally molded with the block 10, rather than manufacturing the block 10 and the casing 12 separately, as described below.

Contact between the blocks 10 is improved if the block faces 62 are shaped in a complementary manner. Preferably, each block 10 has at least one flat face 62 to promote level contact with any other block 10. Many of the blocks 10 are cubical or cuboid in shape, so that all sides are flat. Because the blocks 10 are used as toy building blocks 10, a number of different sizes and configurations of blocks 10 is desirable, allowing for versatility and encouraging creativity. Accordingly, many other flat-faced block 10 shapes may be used with the present invention, including "I-shaped," "T-shaped," or "L-Shaped" blocks 10, or pyramids, parallelipipeds, or even curved blocks 10 with flat faces 62. Alternately, some pairs of blocks 10 may have complementary faces 62 that are not flat. Although the magnetic attraction of the magnets 14 may be sufficient to hold two blocks 10 together if their faces 62 are not shaped in a complementary manner, it is nevertheless preferred that the faces 62 be complementarily shaped.

Figure 8:
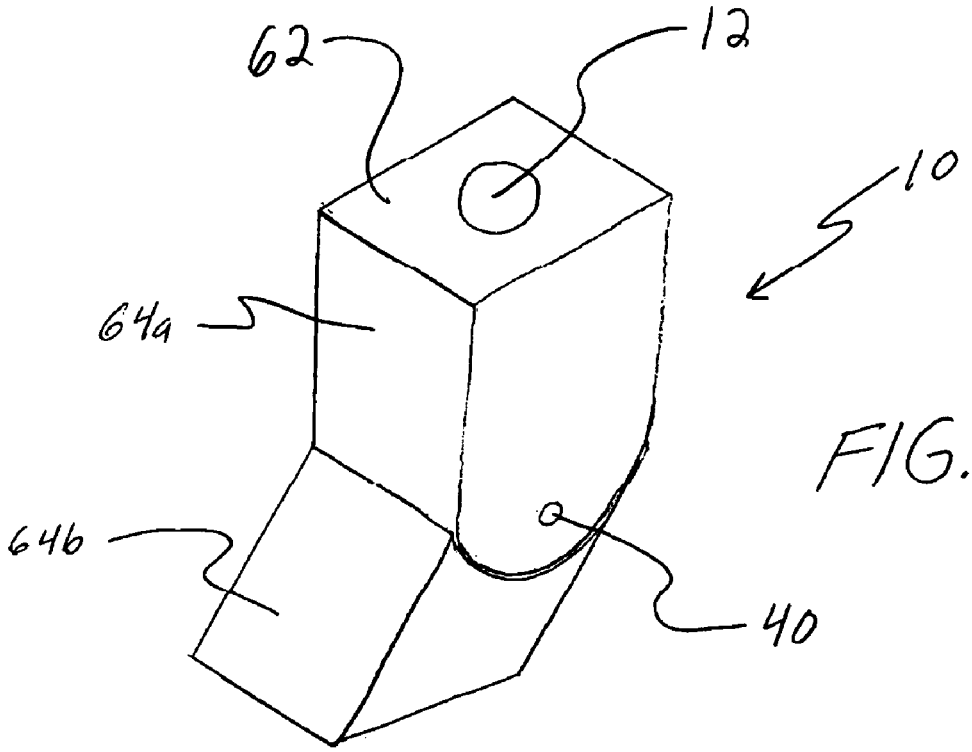
FIG. 8 is a perspective view of a fifth embodiment of the toy of the present invention.
Figure 9:
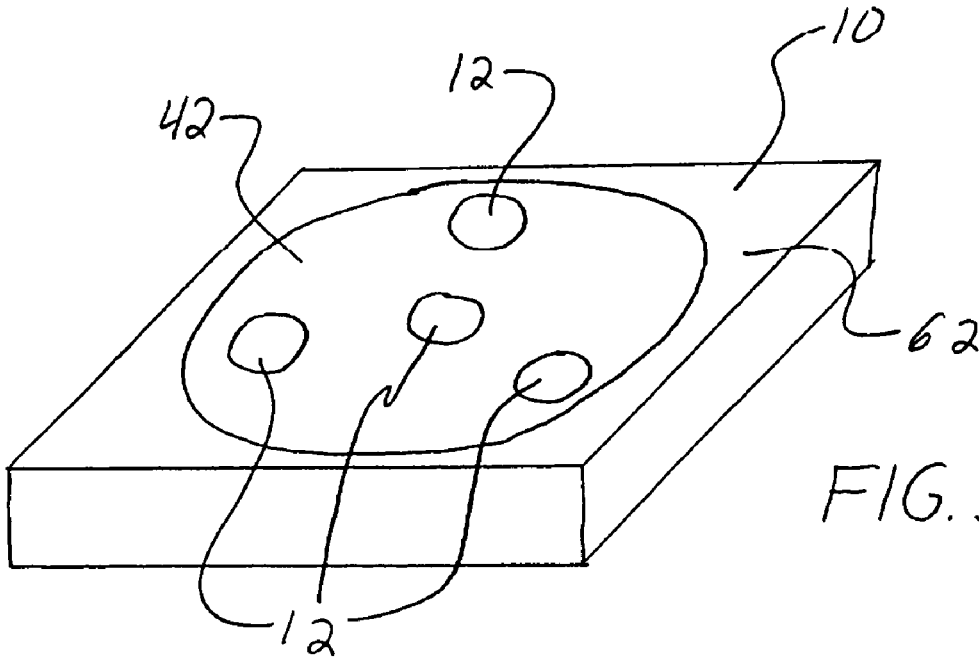
FIG. 9 is a perspective view of a sixth embodiment of the toy of the present invention.

As an additional feature, some blocks 10 of the present invention may contain joints or other moveable parts. For example, a two-piece block 10 with a hinge-type joint 40 connecting the two pieces 64*a*,64*b*, as shown in FIG. 8, adds great versatility to a set of building blocks 10. Such a block 10 would likely not be feasible in an ordinary building block 10 system without some type of connection, such as the magnetic connections of the present invention. Also, a block 10 of the present invention may have a rotating platform 42 embedded in the block 10, as shown in FIG. 9, or projecting from the surface of the block 10. This rotating platform 42 contains one or more magnet casings 12 to permit attachment of one or more other blocks 10, allowing for the creation of a moveable structure.

Figures 13, 14:
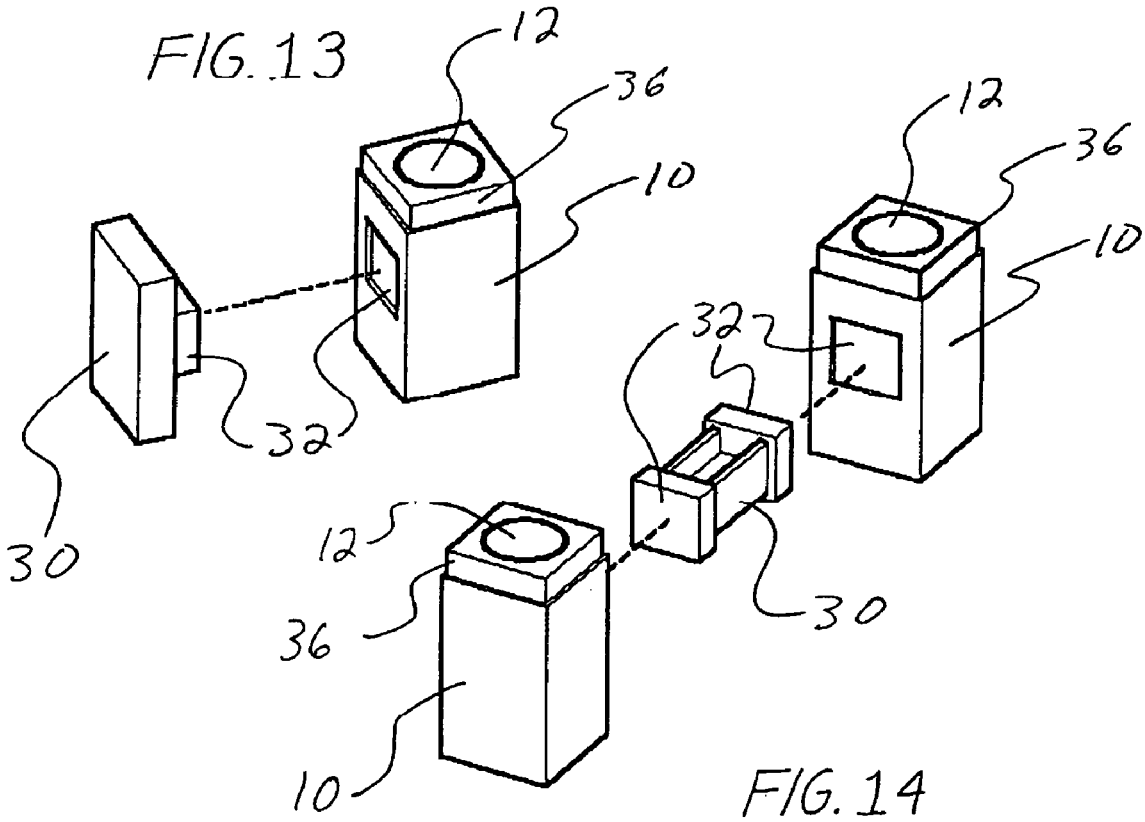
FIG. 13 is a perspective view of a ninth embodiment of the toy of the present invention, showing a connector and a block, with broken lines showing the connection between the connector and the block.
FIG. 14 is a perspective view of a tenth embodiment of the toy of the present invention, showing a connector and two blocks of the present invention, with broken lines showing the connections between the connector and the blocks.

In a further embodiment, the blocks 10 may have snap fit connections 32 in addition to the magnets 14 and casings 12, as shown in FIGS. 13-14. Snap fit connections 32 are connections adapted to be mechanically connected to blocks 10 with complementarily-shaped connections. Examples of snap fit connections 32 are interlocking fits and interference fits, among others. The snap fit connections 32 in FIGS. 13-14 are shown for use in attaching a connector 30 to one or more blocks 10. Additionally, blocks 10 of the present invention can be equipped with complementary snap fit connections 32 for attachment to other blocks 10, without the need for connectors 30. A variety of different connectors 30 are discussed below, which may be used in accordance with the present invention.

The present invention contemplates the use of connectors 30 to connect to blocks 10 and to connect multiple blocks 10 together in other manners than those described above. The connectors 30 shown in FIGS. 10-12 and 14 are configured to connect multiple blocks 10 together, while the connector 30 in FIG. 13 simply connects to a single block 10, changing the geometry of that block 10. The connectors 30 are beneficial because they allow blocks 10 to be connected at a greater number of angles and positions relative to each other, increasing the number of potential building configurations. For example, the connectors 30 illustrated in FIGS. 10-12 allow for a right-angle connections between blocks 10. Additionally, the connectors 30 can increase the number of potential constructions and configurations by changing the geometry of the blocks 10, thereby increasing the versatility of the blocks 10. Further, because snap fit connections 32 are often stronger than magnetic connections, they can support a greater range of building configurations, adding still greater versatility to the blocks 10.

Figures 10, 11, 12:
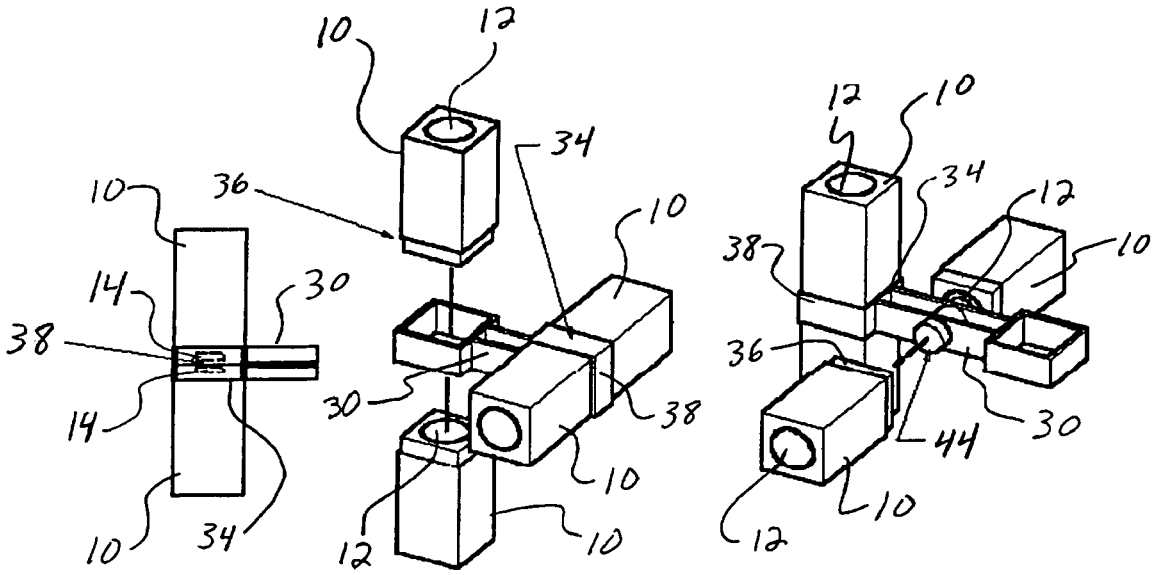
FIG. 10 is a perspective view of a seventh embodiment of the toy of the present invention, showing a connector and four blocks, with broken lines showing the connection between two blocks.
FIG. 11 is a partial side elevation view of the toy of FIG. 10, with broken lines showing the positions of the magnets within the blocks.
FIG. 12 is a perspective view of an eighth embodiment of the toy of the present invention, showing a connector and four blocks, with broken lines showing the connection between a block and the connector.

Preferably, the connector 30 includes a collar 34 adapted to mechanically connect with two adjoining blocks 10, as illustrated in FIGS. 10-12. Each block 10 has an indent 36 at an end, narrowing the cross-sectional area and allowing the end to fit inside the collar 34 up to the end of the indent 36. Another block 10 with a similar indent 36 is inserted into the other side of the collar 34, magnetically connecting with the first block 10 to form a juncture 38. In this configuration, the collar 34 encloses the juncture 38 between the two blocks 10.

Another feature that may be present on the connector 30 is a magnetic contact 44, allowing blocks 10 to be magnetically connected to the connector 30. The magnetic contact 44 may be any magnetically-attractable item, such as a magnet or a metal slug. A connector 30 having a magnetic contact 44 is shown in FIG. 12. The connector 30 may also include a snap fitting connection, as described above and illustrated in FIGS. 13 and 14.

The three principal components of the children's toy of the present invention (the block 10, the casing 12, and the magnet 14) are preferably all permanently affixed together to form a single unit. The magnet 14 is completely sealed within the casing 12, which is affixed to the block 10 in one of several possible ways.

In one embodiment, the casing 12 is affixed to the block 10 by molding the casing 12 integrally with the block 10, as shown in FIGS. 5-7. This may be accomplished in several ways. As shown in FIG. 5, the block 10 may be constructed of two identical pieces 46*a*,46*b*, each with integral internal ribs 50 forming half of a casing 52 in each piece. These two pieces 46*a*,46*b* are joined together, forming a block 10 with integral casings 12. Another way of integrally forming the block 10 and casing 12 is illustrated in FIG. 6, where the block 10 is constructed of two differently designed pieces 48*a*,48*b*. The first piece 48*a* contains integral ribs 50 forming a full casing 12, and the second piece 48*b* contains integral ribs 50 forming a seal 54 on the casing 12 when the two pieces 48*a*,48*b* are joined together. In FIG. 6, the rib 50 forming the casing 12 is cylindrical, and the ribs 50 forming the seal 54 are cross-shaped, although a variety of other shapes will function suitably for the casing 12 or the seal 54. A third way of integrally forming the block 10 and casing 12 is illustrated in FIG. 7, where the block 10 is constructed of two complementarily-shaped pieces 56*a*,56*b*. The first piece 56*a* contains a casing 12 extending beyond the edge of the piece and the second piece 56*b* contains a receptacle 58 configured to fit the casing 12 within. When the pieces 56*a*,56*b* are joined together, the casing 12 projects inside the receptacle 58, sealing the casing 12. The blocks 10 discussed herein with integrally formed casings 12 are preferably hollow, having a large cavity 16, but may also be solid or partially hollow. The pieces of these blocks 10 are preferably joined by ultrasonic welding, but may alternatively be joined by other means known in the art, such as gluing or attaching with fasteners, such as screws. Alternately, the casing 12 may be molded integrally with the block 10 in a one-piece design (not shown).

Figure 15:
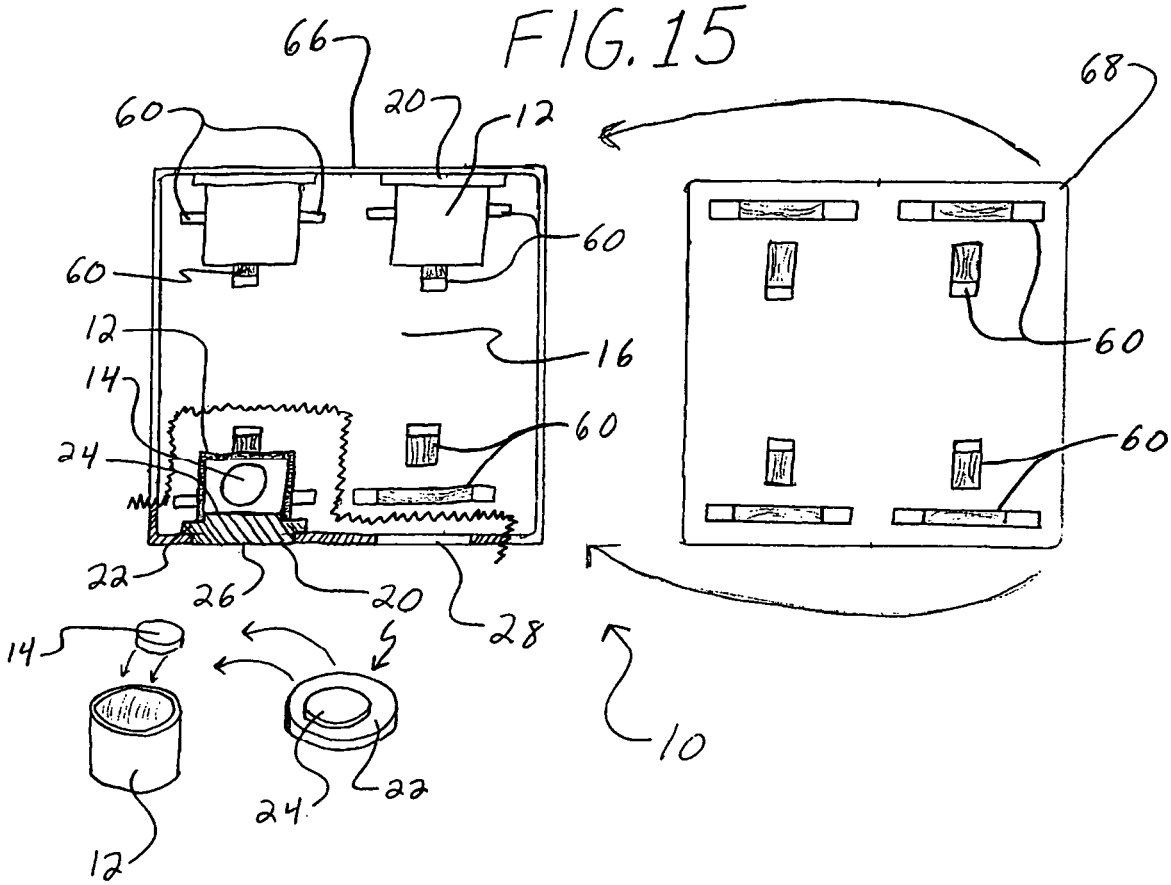
FIG. 15 is a partially exploded, partially cut-away side elevation view of an eleventh embodiment of the toy of the present invention, showing a block, magnets, and casings, with jagged lines indicating a cut-away portion of the block and casing.
Figure 16:
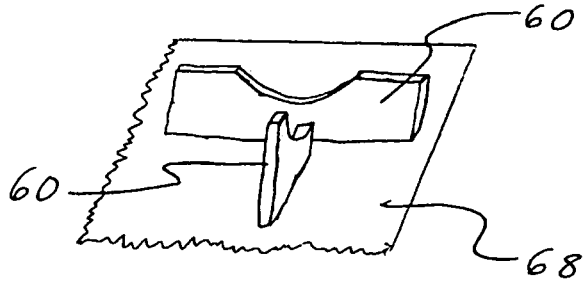
FIG. 16 is a perspective view of internal ribs of the block of FIG. 15.

In the preferred embodiment, the casing 12 is affixed to the block 10 inside a cavity 16 in the block 10. Preferably the block 10 is of a hollow two-piece design, having a large cavity 16, and internal supports 60 are molded into the block 10 to hold the casing 12 in place. The preferred design for this embodiment is shown in FIGS. 15 and 16. The block is made of two pieces, the main body 66 and the lid 68, both having supports 60. The block 10 has holes 28 which accommodate the tops of the casings 12. The casing 12 has a cap 20 on the top with a flange 22 to prevent the casing 12 from being forced through the hole 28. The supports 60 and the flange 22 hold the casings 12 firmly in place, so no additional means is necessary to secure the casings 12 within the cavity 16. FIG. 15 depicts such a block 10, having several casings 12. The corner of FIG. 15 is a partial cut-away cross section, showing how the casing 12 sits within the block 10. The casing 12 in the adjacent corner of FIG. 15 has been removed and is shown in an exploded view to illustrate the components of the magnet casing 12.

Alternately, the block 10 may be solid, and the cavity 16 is preferably dimensioned to fit the casing 12 exactly, with no room for movement on either side and with the level contact surface 18 of the casing 12 flush with the flat surface of the block 10. In this case, the casing 12 is secured within the cavity 16 by glue or other known methods of securing two surfaces together. Rather than being fixed inside the block 10, the casing 12 may be affixed to the exterior of the block 10, forming a projection from the block 10 surface (not shown). This configuration may be advantageous for some purposes, such as to create a more diverse range of block 10 shapes. Such a casing 12 can be contoured as desired. The casing 12 may be affixed to the outside of the block 10 by gluing, ultrasonic welding, or attaching with fasteners, like screws, or by molding the casing 12 integrally with the block 10.

When the magnet casing 12 is placed in proximity of another magnetic element, the magnetic forces will cause the magnet 14 inside the casing 12 to move to align itself to form an attractive force with the other magnetic element. Such magnetic elements include fixed or freely moveable magnets, as well as ferromagnetic and other magnetically-attractable metals. Because the magnet 14 is freely moveable, it can position itself to form an attractive force with any magnetic element, regardless of the orientation of the poles (if any) of the other magnetic element. Thus, once the block 10 of the present invention is assembled, it can be magnetically attached to other blocks 10 having magnet casings 12 by simply positioning the blocks 10 such that the magnet casings 12 are in the proximity of each other. The magnetic forces between the two magnets 14 inside the casings 12 will cause the magnets 14 to move so the north pole of one magnet 14 is proximate the south pole of the other. This positioning will create an attractive magnetic force between the two magnets 14 and the blocks 10 will be held together by this attractive force. The blocks 10 can also be attached to a fixed magnetic element, such as a magnet or a metal contact, because the freely moveable magnet 14 will orient itself to attract the magnetic element.

Preferably, each block 10 has several magnet casings 12 to allow several blocks 10 to be attached to the same block 10. It should be noted that the magnet casings 12 are preferably not so numerous or closely spaced in the block 10 that the magnets 14 of the same block 10 interfere with one another. By attaching several blocks 10 together, a child can stack the blocks 10 in an endless variety of configurations, promoting innovation and creativity on the part of the child.

Although specific embodiments have been illustrated and described, numerous modifications are possible without departing from the essence of the invention. Accordingly, the scope of this patent is solely limited by the scope of the accompanying claims.

We claim:

1. A children's toy comprising:

a first block having a plurality of walls defining a substantially hollow interior, at least one of the walls including an opening;

a first internal support extending from at least one of the walls and into the hollow interior of the first block;

a first casing mounted within the hollow interior of the first block, wherein the first internal support engages the first casing to support the first casing within the hollow interior;

a first magnet housed within the first casing, the first magnet freely moveable within the first casing; and a cap adapted to be received within the opening and to enclose the first casing, the cap including a flange having a circumference greater than a circumference of the opening, the flange positioned within the hollow interior.

2. The children's toy of claim 1, wherein the first magnet is disk-shaped and comprises a first circular face and a second circular face oppositely magnetically polarized with respect to the first circular face.

3. The children's toy of claim 1, further comprising:

a plurality of internal supports within the hollow interior of the first block;

a plurality of casings mounted within the hollow interior of the first block, wherein at least one of the plurality of internal supports engages each casing to support the casing within the hollow interior; and a plurality of magnets, each casing housing one of the plurality of magnets such that each magnet is freely moveable within each casing.

4. The children's toy of claim 3, wherein each of the plurality of magnets is disk-shaped and comprises a first circular face and a second circular face oppositely magnetically polarized with respect to the first circular face.

5. The children's toy of claim 1, further comprising:

a second block having an exterior surface defining a substantially hollow interior;

a second internal support within the hollow interior of the second block;

a second casing mounted within the hollow interior of the second block, wherein the second internal support engages the second casing to support the second casing within the hollow interior; and a second magnet housed within the second casing, the second magnet freely moveable within the second casing, wherein the first and second blocks are temporarily connectable by magnetic attraction between the first and second magnets.

6. The children's toy of claim 1, further comprising:

a second internal support within the hollow interior of the first block, wherein the first internal support extends inwardly from a first interior surface of the first block, into the hollow interior, and the second internal support extends inwardly from a second interior surface of the first block, into the hollow interior, wherein the first internal support and the second internal support engage the first casing and support the first casing within the hollow interior.

7. A children's toy comprising:

a substantially hollow block having a plurality of faces forming an exterior surface and defining a substantially hollow interior;

a first casing mounted within the hollow interior of the block adjacent a first face of the block, the first casing supported within the hollow interior by a first internal support contained within the hollow interior of the block, wherein the first internal support engages the first casing to support the first casing within the hollow interior;

a first disk-shaped magnet housed within the casing comprising a first circular face and a second circular face oppositely magnetically polarized with respect to the first circular face, the first casing having sufficient clearance space with respect to a size of the first magnet to allow unrestricted free movement of the first magnet within the first casing;

a second casing mounted within the hollow interior of the block adjacent a second face of the block, the second casing supported within the hollow interior by a second internal support contained within the hollow interior of the block, wherein the first internal support engages the first casing to support the first casing within the hollow interior; and a second disk-shaped magnet housed within the casing comprising a first circular face and a second circular face oppositely magnetically polarized with respect to the first circular face, the second magnet having unrestricted free movement within the second casing.

8. The children's toy of claim 7, wherein the first internal support and the second internal support extend inwardly from an interior surface of the block, into the hollow interior.

9. The children's toy of claim 7, further comprising:

a third internal support contained within the hollow interior of the block proximate the first internal support, wherein the third internal support engages the first casing to cooperate with the first internal support to support the first casing within the hollow interior; and a fourth internal support contained within the hollow interior of the block proximate the second internal support, wherein the fourth internal support engages the second casing to cooperate with the second internal support to support the second casing within the hollow interior.

10. A children's toy comprising:

a block having a plurality of faces and an interior cavity;

a plurality of internal supports extending into the interior cavity of the block;

a first casing mounted within the interior cavity adjacent a first face of the block, wherein at least one of the plurality of internal supports engages the first casing to support the first casing within the interior cavity;

a first magnet housed within the first casing the first casing having sufficient clearance space with respect to a size of the first magnet to allow unrestricted free movement of the first magnet within the first casing;

a second casing mounted within the interior cavity adjacent the first face of the block and adjacent the first casing, wherein at least one of the plurality of internal supports engages the second casing to support the second casing within the interior cavity; and a second magnet housed within the second casing, the second magnet having unrestricted free movement within the second casing the second casing having sufficient clearance space with respect to a size of the second magnet to allow unrestricted free movement of the second magnet within the second housing.

11. The children's toy of claim 10, further comprising:

a third casing mounted within the interior cavity adjacent a second face of the block, wherein at least one of the plurality of internal supports engages the third casing to support the third casing within the interior cavity;

a third magnet housed within the third casing, the third magnet freely movable within the third casing;

a fourth casing mounted within the interior cavity adjacent the second face of the block, wherein at least one of the plurality of internal supports engages the fourth casing to support the fourth casing within the interior cavity; and a fourth magnet housed within the fourth casing, the fourth magnet freely movable within the fourth casing.

12. The children's toy of claim 10, further comprising:

a third casing mounted within the interior cavity adjacent a second face of the block, wherein at least one of the plurality of internal supports engages the third casing to support the third casing within the interior cavity; and a third magnet housed within the third casing, the third magnet freely movable within the third casing.

13. The children's toy of claim 10, wherein the block comprises a main body and a removable lid coupled to the main body, wherein at least one of the plurality of internal supports is affixed to the lid.

14. The children's toy of claim 13, wherein the lid defines one of the plurality of faces of the block, and the main body defines the remainder of the plurality of faces of the block.

15. The children's toy of claim 13, wherein a first and a second of the plurality of internal supports are affixed to an interior surface of the lid and a third and a fourth of the plurality of internal supports are affixed to an interior surface of the main body, and wherein the first internal support and the third internal support engage the first casing to cooperatively support the first casing within the interior cavity and the second internal support and the fourth internal support engage the second casing to cooperatively support the second casing within the interior cavity.

16. The children's toy of claim 15, wherein the interior surface of the lid and the interior surface of the main body are located on opposite sides of the block, and wherein the first internal support and the third internal support extend inwardly toward each other into the interior cavity and the second internal support and the fourth internal support extend inwardly toward each other into the interior cavity.

17. The children's toy of claim 10, wherein the internal support extends inwardly from an interior surface of the block, into the hollow interior.

* * * * *